United States Patent [19]

Hager et al.

[11] Patent Number: 5,018,465

[45] Date of Patent: May 28, 1991

[54] SEWING MACHINE WITH THREAD MONITOR

[75] Inventors: Walter Hager; Edgar Butzen; Günther Denuell; Kurt Arnold, all of Kaiserslautern, Fed. Rep. of Germany

[73] Assignee: Pfaff Industriemaschinen GmbH, Kaiserslautern, Fed. Rep. of Germany

[21] Appl. No.: 469,566

[22] PCT Filed: Sep. 3, 1988

[86] PCT No.: PCT/EP88/00800

§ 371 Date: Apr. 9, 1990

§ 102(e) Date: Apr. 9, 1990

[87] PCT Pub. No.: WO89/03908

PCT Pub. Date: May 5, 1989

[30] Foreign Application Priority Data

Nov. 21, 1987 [DE] Fed. Rep. of Germany ..... 3735578
Jan. 13, 1988 [DE] Fed. Rep. of Germany ..... 3800717

[51] Int. Cl.[5] ..... D05B 69/36
[52] U.S. Cl. ..... 112/273

[58] Field of Search ..... 112/273, 278, 277, 121.11, 112/279, 228, 231

[56] References Cited

U.S. PATENT DOCUMENTS 4,192,243 3/1980 Blessing et al. ..... 112/273
4,693,196 9/1987 Hager ..... 112/273
4,732,098 3/1988 Mertel et al. ..... 112/273 X

FOREIGN PATENT DOCUMENTS 3625630 2/1988 Fed. Rep. of Germany ..... 112/273
2600085 12/1987 France ..... 112/273

*Primary Examiner*—Peter Nerbun
*Attorney, Agent, or Firm*—McGlew & Tuttle

[57] ABSTRACT

The control circuit of a catch thread device has a counter for the main shaft of the swing machine. The counter counts the number of revolutions of the main shaft 26 during the reception of one of at least two signal intensities and is reset to its initial value when this signal intensity changes to the other signal intensity. When a predetermined maximum number of revolutions is reached, the counter emits a signal indicating a thread fault.

13 Claims, 4 Drawing Sheets

M
1
23
20
&
19
18
17
14
13
16
15
E1
E2
E3
A
21
22
25
PP
30
31
27
26
32
33
28
29
34
&
44
≥1
45
46
47
48
49
24
M
50
26
37
36
35
ZA
ZE1
ZE2
ZE3
W
F
P
M

SEWING MACHINE WITH THREAD MONITOR

BACKGROUND OF THE INVENTION

Field of the Invention

The present invention relates in general to a sewing machine and in particular to a new and useful method and apparatus for effecting various sewing operations.

A thread monitor for a sewing machine, which has a counter with a counting input, a resetting input, and a presetting input for entering count values is known from U.S. Pat. No. 4,192,243. The pulses of a pulse generator, which generates a predetermined number of pulses, which can be predetermined, per revolution of the main shaft, are sent to the counting input, while a pulse generator driven by the thread pull is connected to the resetting input.

The counter is reset to a starting value by each pulse arriving at the resetting input. Based on this value, the counter sums up the pulses on the counter input until it is again reset by the next resetting pulse. However, when the counter has counted up to the count value set on the presetting input before the next resetting pulse is sent, there is a thread disturbance. Based on this, the counter sends a signal which triggers an alarm or machine stop.

Even though the needle thread can be easily monitored by a thread monitor of such a design to detect thread end and breakage, it is stipulated in that patent that the shuttle thread on a double lock stitch sewing machine can be monitored via the needle thread by detecting its consumption, rather than directly. Therefore, in conjunction with such a sewing machine, this thread monitor is unable to respond to disturbances on the shuttle thread rapidly and with sufficient sensitivity.

British patent specification No. 13 35 677 discloses a sewing machine whose bobbin has a marking formed by light and dark fields on its flange facing a light source and a light receiver. As long as thread is being pulled off, the marking of the rotating bobbin acts as a pulse generator. However, the pulse sequence changes in the case of thread break or thread end, as a result of which the shut-off mechanism of the sewing machine is actuated via electrical or electronic means following the light receiver.

Due to the inertia of the bobbin, thread monitors responding to changes in the pulse sequence have the disadvantage that a reduction of the sewing machine speed brings about bobbin feed. This can cause the bobbin to stop briefly, which causes the thread monitor to respond, despite continued thread pull-off.

U.S. Pat. No. 3,738,296 discloses a bobbin which has a reflective surface. The light beams of a reserve monitoring device, which are deflected by this surface, are sent as light signals to a counter of an external control circuit. The number of bobbin revolutions taking place during sewing is summed up in the counter, and this actual value is compared to a preselected nominal value. The sewing machine is stopped when the two values are equal.

Even though the arrangement described in the U.S. Patent Specification makes it possible to preselect the amount of residual thread according to the needs, rupture of the bobbin thread is not indicated.

SUMMARY OF THE INVENTION

It is an object of the invention to design a thread monitor of this class so that the thread monitor will monitor the shuttle thread directly for rapid and sensitive indication.

The invention provides a thread monitor which will monitor the shuttle thread directly for rapid and sensitive indication.

According to the invention, a bobbin which is held in the shuttle body is provided as a reflector for reflecting signals sent by a signal sending element. The bobbin includes a plurality of reflection surfaces with different reflection characteristics. A receiving element cooperating with the sending element to form a sensor, detects the change in the signal which is brought about by the differences in reflection. This sensed change is sent by the sensor in the form of pulses to the resetting input of a counter. A pre-setting input of the counter is connected to a setting device for preselecting a maximum count.

Because the bobbin is designed as a reflector for signals which are to be sent from a sensing device to a sensor acting as a receiver, neither the sensing device nor the sensor need to be arranged in the immediate vicinity of the bobbin, which is advantageous in light of the limited space in the area of the shuttle.

Due to the difference in the reflection behavior of the reflective surfaces of the bobbin, a constant signal of the sensing device can be converted into pulses which are sent to the resetting input of the counter in a sequence that depends on the thread consumption.

Based on this mode of action of the bobbin, no separate pulse generator driven by the thread pull is needed. This considerably simplifies the subsequent installation of the thread monitor in sewing machines.

Various types of sensors can be used to monitor the rotation of the bobbin; monitoring may be performed, for example, electronically, magnetically, electrically, or pneumatically.

The count value up to which the counter sums up the pulses delivered per stitch forming cycle can be set via the presetting input of the counter. The switching operation is triggered when this count value is reached.

The count value should be selected to be as low as possible in view of the short reaction time until stoppage of the sewing machine. On the other hand, it should not be lower than a minimum in order to prevent a brief stoppage of the bobbin due to a short slack thread from causing malfunction of the thread monitor. Such a stoppage is, for example, the consequence of bobbin feed, which may occur as a result of a slight reduction of the sewing machine speed during the sewing operation.

In the case of a relatively long slack thread section after an intermediate stoppage, especially after deceleration of the sewing machine from the maximum speed to stop, an additional counting device, by which the action of the counter of the main counting device is abolished until the maximum possible amount of slack thread is used up, is advantageous.

A relatively large amount of thread is fed during thread cutting. On restart, this slack thread must first be used up before the bobbin is set into rotation by repeated thread after draft. Therefore, advantageously, another additional counting device is provided, by which the counter of the main counting device is turned on only after this slack thread has been used up completely.

The value of at least one additional counting device can be set by the measure so that switching back to the counter of the main counting device takes place as early as possible after the slack thread has been used up completely. However, by providing that the counter can be driven as a function of the actual operating state of the sewing machine, which deviates from the sewing operation, so that a number of main shaft revolutions associated with the operating state can be determined which then results in a switching over to sewing operation. One counting device is sufficient, which can be adjusted to the actual state of the sewing machine, such as sewing operation, intermediate stop, or thread cutting.

Whether the thread monitor according to the present invention, the thread is checked after being pulled off from the bobbin or the yarn roll by the continuous alternation of the intensity at short intervals, and the number of stitches, or the number of revolutions of the main shaft which are to be performed prior to display after a thread disturbance, is determined by a maximum that can be preselected. This maximum should be selected to be as low possible in view of the short response time elapsing until the sewing machine is stopped.

A short response time is desirable, for example, when the signal generator has stopped as a consequence of the reduction of the friction between the thread and the bobbin core at the end of the thread, but a sufficient amount of thread is still present to continue the stitch formation at maximum stitch length until the number of stitches corresponds to the maximum that can be preselected.

The maximum should advantageously not be lower than a minimal value, because a slack thread section resulting from a brief stoppage of the bobbin thus does not induce malfunction of the thread monitor. Such a stoppage of the bobbin is the consequence of, e.g., a bobbin feed, which may occur as a result of a reduction of the sewing machine speed during the sewing operation. The measure according to which the number of stitches prior to the next change is counted proved to be advantageous, because the slack thread is used up after a few stitches and the bobbin is rotated further.

The thread monitor may operate electro-optically, electromagnetically, pneumatically, or mechanically, depending on the required field of application.

For example, the electro-optical monitoring process has proved to be advantageous for thread monitoring, because the signal generator can be scanned without contact and hence without wear according to a simple technical solution. In addition, electro-optical thread monitors operate relatively accurately and with a short response time.

The advantage of magnetic monitoring processes is the fact that their function has proved to be particularly insensitive to dirt, and they are therefore particularly suitable for use as thread monitors in whose signal path the accumulation of lint generated during sewing cannot be ruled out.

The use of permanent magnets at the signal generator is advantageous, because the thread monitor requires only a receiver suitable for receiving the magnetic signals because of the permanent magnets acting as senders. If this receiver comprises a Hall sensor, it is particularly light-weight and compact.

Other designs of the thread monitor are possible including one in which the proximity switch responds to inductive or capacitive signal changes and advantageously the sensor responds to pressure changes.

A larger, freely preselectable amount of residual thread to be metered relatively accurately is advantageous also. Such a counting device has proved to be advantageous especially in sewing units on which larger parts are sewn.

Accordingly, it is an object of the invention to provide a thread monitor for controlling the feed of a thread in a sewing machine in accordance with the drive speed of the sewing machine wherein a rotating bobbin is provided that rotates so that a sensing surface with variable sensing areas is picked up by the scanning of the sensor which has a resetting device which effects resetting after counting is done by a counting device associated therewith.

A further object of the invention is to provide a sewing machine thread monitor which is simple in design, rugged in construction and economical to manufacture.

A further object of the invention is to provide a method of monitoring the operation of the sewing machine which feeds sewing thread off a rotating bobbin which has a reflecting surface which is picked up by a sensing device so as to send a signal to a counter and resetting device.

A further object of the invention is to provide a method of operating a sewing machine which is easy to carry out and which produces a better control of the feed of a thread.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENTS

Figure 1:
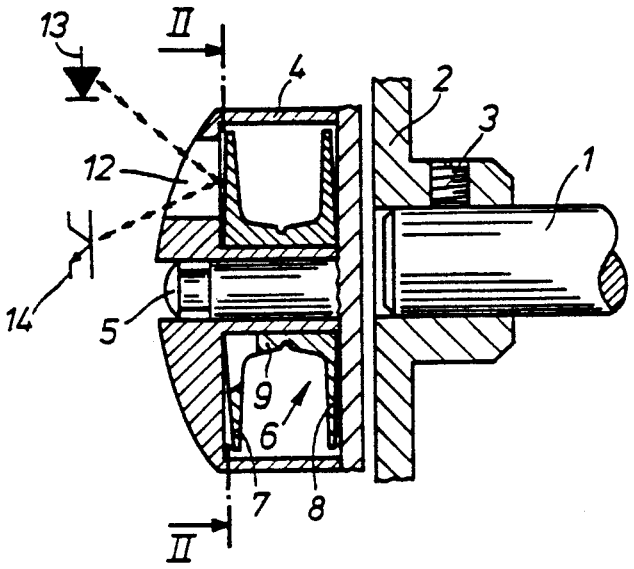
FIG. 1 is an axial sectional view through the shuttle of a sewing machine constructed in accordance with the invention.
Figure 2:
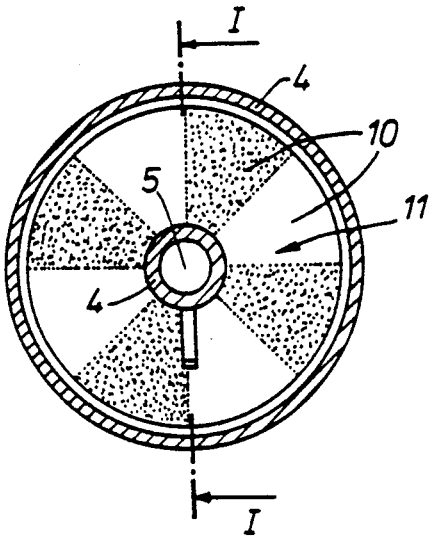
FIG. 2 is a sectional view taken along line II—II in FIG. 1.

The shuttle drive of a first embodiment, which is shown in FIG. 1, comprises a shuttle drive shaft 1, on which a shuttle body 2, shown only partially, is fastened nonrotatably by a set screw 3.

A bobbin case 4 is mounted in the shuttle body 2, and the bobbin case carries a center pin 5 that carries a bobbin 6 on which thread is wound. A bobbin 6 is provided with a front flange 7 and a rear flange 8, which are connected by a core 9 that can be attached to the center pin 5. On its outside, the flange 7 has a sewing surface or marking 11 formed with variations such as light and dark fields 10.

The bobbin case 4 is designed with an opening 12 for the entry and exit of light signals. The signals are emitted by a light-emitting diode 13, which is indicated only symbolically, and are sent to a photodetector 14 after being reflected on marking 10 of bobbin 11.

Figure 3:
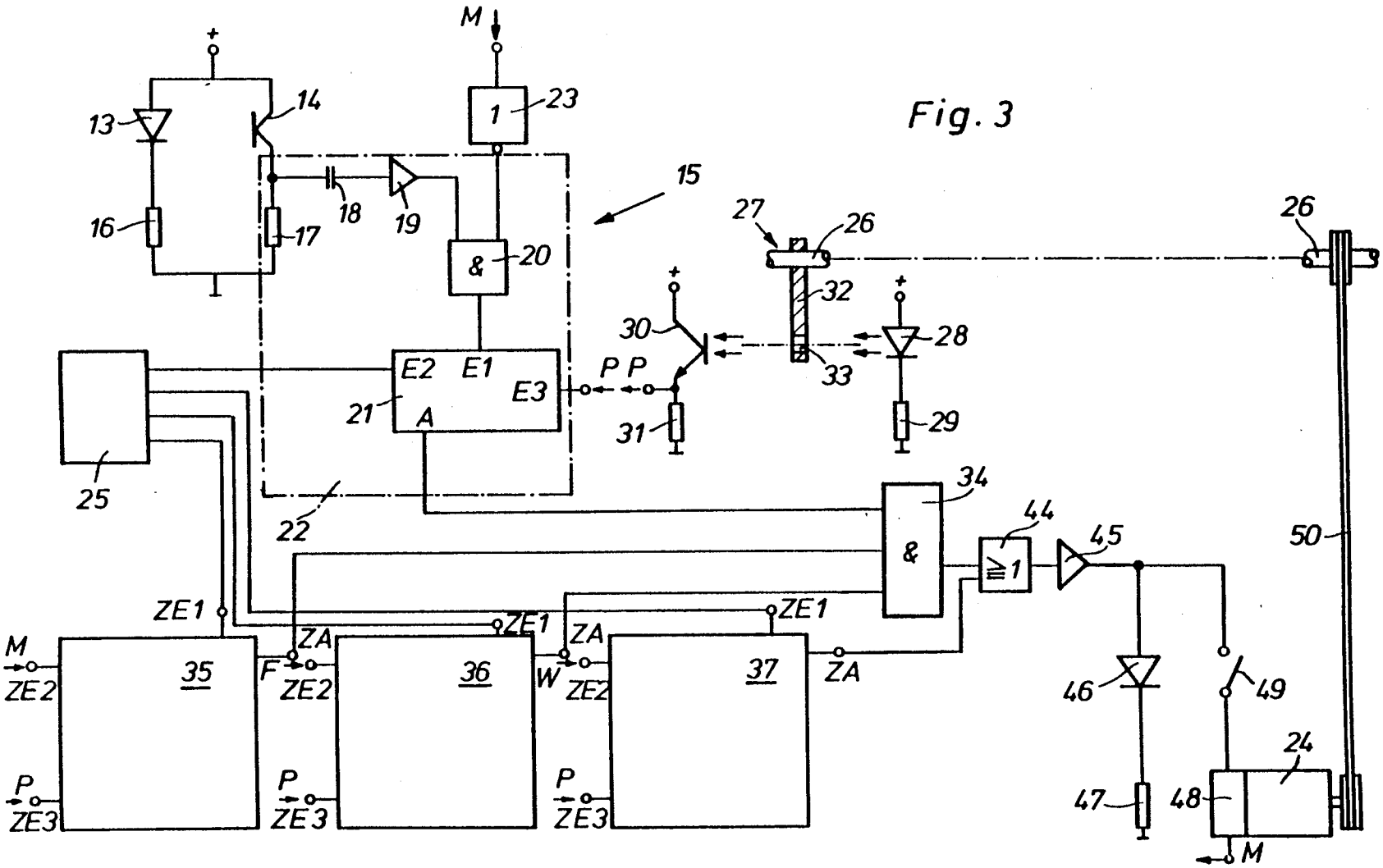
FIG. 3 is a simplified circuit diagram of the monitoring system.
Figure 5:
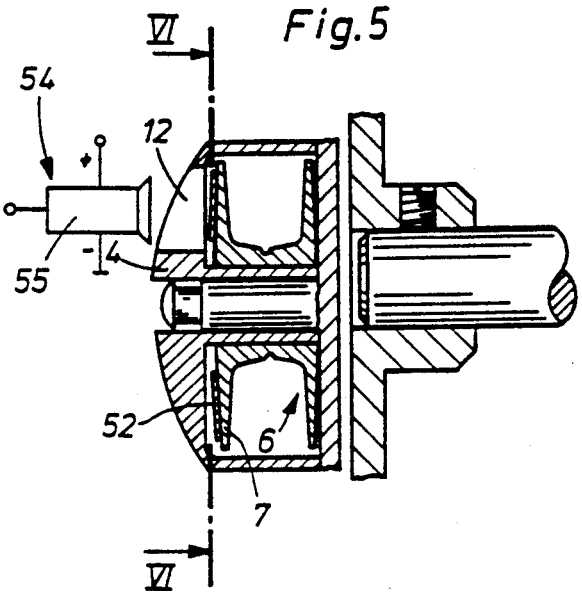
FIG. 5 is a sectional view through a shuttle of another embodiment of the invention along line V—V in FIG. 6.
Figure 6:
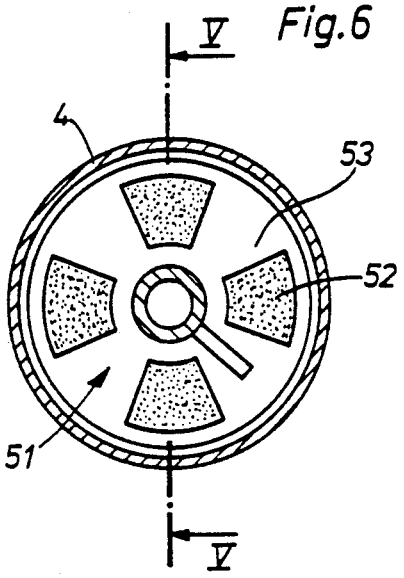
FIG. 6 is a sectional view taken along line VI—VI in FIG. 5.

FIG. 3 shows, in a simplified circuit diagram, the components of a control circuit 15 that are needed for the function of the thread monitor. Current flows from the positive pole of a controlled power source via light-emitting diode 13 and a resistor 16 to ground. Current also flows to ground from the positive pole of the power source via the photodetector 14, designed as a phototransistor, and a resistor 17.

A capacitor 18, which is connected via an amplifier 19 and an AND element 20 to an input El of a counter 2!, is connected to the emitter of the photodetector 14. Together with this counter 21, the components 17 through 20 form a counting device 22.

A pulse M is sent from the output of the drive motor 24 of the sewing machine to a negation element 23 immediately after the drive motor has been turned on. The output of negation 23 is connected to the second input of the AND element 20.

To set the counter 21, a signal corresponding to the necessary maximum can be sent to it via an input E2. The maximum can be preselected on a control panel 25, to which the input E2 is connected. A position transducer 27, which monitors the revolutions of the main shaft 26, is connected to another input E3 of the counter 21. The position transducer has a light-emitting diode 28, which is connected to the positive pole of a controlled power source, and the light-emitting diode 28 is grounded via a resistor 29. A photodetector 30 designed as a phototransistor, is also connected to the positive pole and is grounded via a resistor 31. A disk 32, which is mounted on the main shaft 26 (nonrotatably fixed to the main shaft) and is designed with an opening 33 for the passage of the light beams, is provided in the light path between the light-emitting diode 28 and the photodetector 30. One pulse P is sent to the input E3 of the counter 21 on each passage.

The output A of the counter 21 is connected to an input of an AND element 34. Counting devices 35 through 37 are connected to the other inputs of the AND element 34.

The counting device 35 can be driven by the pulse M sent to the output of the drive motor 24 after each intermediate stop of the sewing machine, while the counting device 36 receives a pulse F from a thread cutting device (not shown) after thread cutting. In contrast, the counting device 37 can be activated by a pulse W by the sewing machine operator actuating an appropriate switch on the sewing machine after replacing the empty bobbin with a full one. All three counting devices 35 through 37 are connected to the position transducer 27 and receive the pulses P sent by same.

Figure 4:
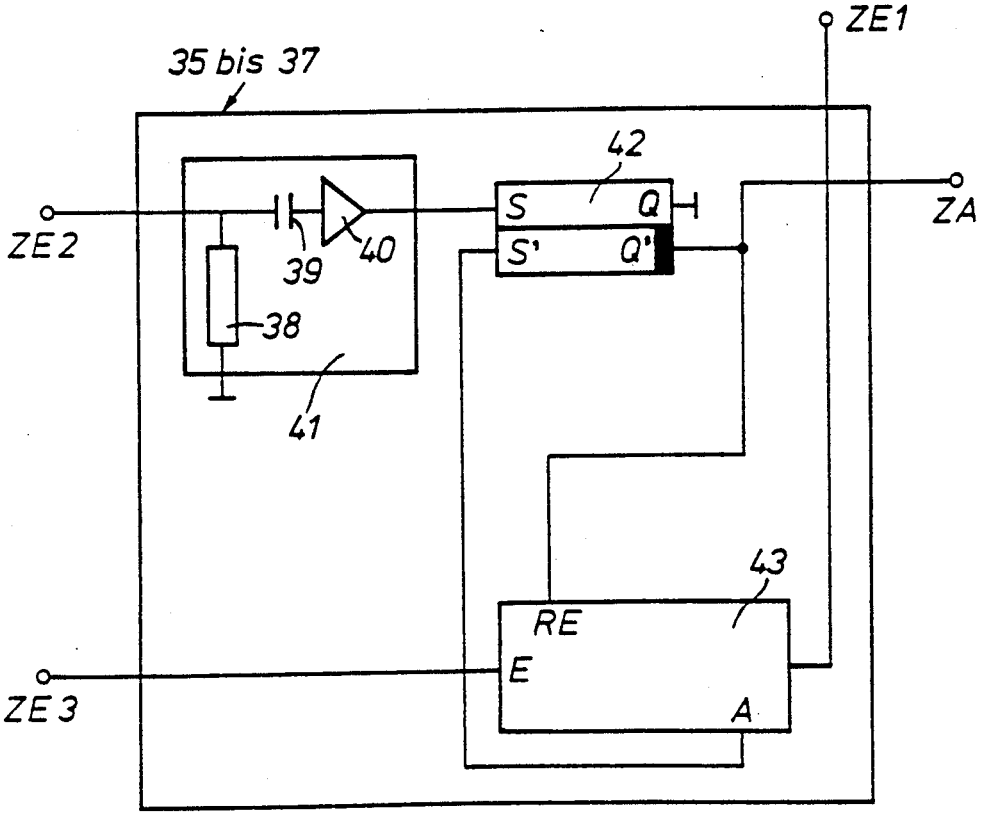
FIG. 4 is a circuit diagram of the counting device.

The individual counting devices 35 through 37 are of identical design, and, as is apparent from FIG. 4, each of them has a dynamic member 41 formed by a resistor 38, a capacitor 39, and an amplifier 40, a flip-flop memory 42, and a counter 43.

One input ZE1 (FIGS. 3 and 4) of each counting device 35 through 37 is connected to the control panel 25, whereas the pulses M, F or W sent by the sewing machine are received on input ZE2 and the pulses P are received on input ZE3. Output ZA of the corresponding counting device 35 through 37 is connected to one input each of the AND element 34.

The dynamic member 41 is connected to the input ZE2 of the corresponding counting device 35 through 37 and causes the pulses received M, F or W to be present on the input S of the memory 42 for a short time only (see FIG. 4). The other input S' of the memory 42 is connected to the output A and the output Q' of the memory 42 is connected to the resetting input RE of the counter 43. The output Q' is also connected to the output ZA of the counting device.

The output of the AND element 34 (FIG. 3) is connected to an OR element 44, to which the counting device 37 is also connected. The output of the OR element 44 is connected via an amplifier 45 to a display member 46, which is grounded via a resistor 47. A switch 49, which is connected to a shut-off device 48 for the drive motor 24 is also connected to the output of the amplifier 45. The drive motor 24 drives the main shaft 26 via a V-belt 50.

The first embodiment operates as follows:

During the operation of the sewing machine, the light beams of light- emitting diode 13 fall on marking 11 through the opening 12 of the bobbin case 4. The light is reflected on the marking and is sent to the photodetector 14 after re-exiting from the opening 12. If the bobbin 6 is rotated as a consequence of thread being pulled off during the sewing operation, the light receiver 14 successively receives signals of different light intensity. However, a signal of constant light intensity is present during the stoppage of the bobbin as a consequence of thread break or thread end.

Only the signal generated during the transition from a darker to a lighter field 10 of the marking 11 is evaluated by the control circuit 15 of this embodiment. However, the thread monitor would be just as readily able to function if only the transitions from a lighter to a darker field or both transitions were evaluated.

During each such transition, the photodetector 14 becomes conductive and current flows to ground via the resistor 17.

The voltage now building up is sent to the AND element 20 via the capacitor 18 and the amplifier 19. The capacitor 18 advantageously serves to filter out direct currents caused by daylight and low-frequency alternating current caused by a light of the sewing machine.

During sewing, the drive motor 24 sends no pulse M to the negation element 23, so that a signal with "high" potential, hereinafter called signal H, is present on its output. As soon as such a signal is also sent to the output of the amplifier 19, the counter 21 receives a signal H via its input E1 and is hereby reset into its starting position, the value zero. The counter 21 now starts to sum up the signals arriving at the input E3 from the position transducer 27; each signal corresponds to one revolution of the main shaft 26 and hence to one stitch made. As long as the bobbin rotates, the counter 21 is repeatedly zeroed by the corresponding signal received at the input El before the maximum set on the, control panel 25 and preselected via the input E2 is reached. This value can be found, for example, by determining by measurement the number of revolutions of the main shaft 26 with full bobbin and the shortest stitch length that can be set on the sewing machine, which is needed for rotating the bobbin 6 from one field 10 to the next.

When the bobbin 6 has stopped as a consequence of a thread disturbance, the counter 21 continues counting up to the preselected maximum and sends a signal H from its output A to the AND element 34. As will be discussed in detail later, the counting devices 35 through 37 are connected such that signal H is always present on their outputs ZA during the sewing operation. The signal H of the counter 21 is therefore able to pass through the AND element 34 unhindered. After subsequent passage through the OR element 44 and through the amplifier 45, the signal actuates the display device 46, and if the switch 49 is closed, at the same time also the shut-off device 48, which, depending on the design of the drive motor 24, either shuts the motor off immediately or prevents it from being restarted after the next stopping process.

When the drive motor 24 is actuated for the first time after stoppage of the sewing machine, for example, after filling the bobbin 6, the drive motor sends pulse M to the negation element 23. As a result of this, the potential on the output of the negation element 23 briefly changes to "low", hereinafter called signal L for short, so that signals H, which are present on the AND element 20 and arrive from the amplifier 19, are unable to pass through.

At the same time, the pulse M is sent to the input ZE2 of the counting device 35 and reaches the dynamic element 41 via it. The duration of the pulse M is limited by its capacitor 39, which acts as a timing element, so that the pulse is present on the input S of the flip-flop memory 42 for a short time only and sets its output Q on the signal H.

As a result of this, signal L is present on the output ZA of the counting device 35, which output is connected to the output Q' of the memory 42, so that the AND element 34 blocks the signal and the signals H from one of the counting devices 22, 36, and 37 are not able to interrupt the rotation of the motor.

The resetting input RE of the counter 43 is also connected to the output Q' of the memory 42. As soon as the signal L is present on this input, it is reset to zero and starts counting via its input P the revolutions of the main shaft 26, until it reaches the maximum preselected via the input ZE1. Then, via its output A, it sends a signal H to the input S' of the memory 42, as a result of which signal H will again be present on its output Q' as well as on the output ZA of the counting device 35.

The mode of operation of the counting devices 36 and 37 corresponds to that of the counting device 35. However, the counting device 37 is to be connected by the OR element 44 to the other counting devices 22, 35, and 36, because the signal L is always present on the output ZA of the counting device 37 during its considerably longer counting interval.

Figure 7:
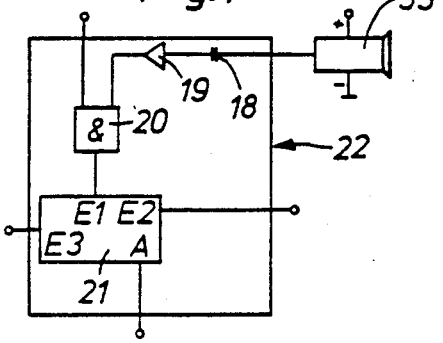
FIG. 7 is a diagram of the counting device associated with the sensor according to FIG. 5.

In a second embodiment, magnets 52, between which a magnet-free field 53 is provided, are arranged on the outside of the flange 7 of the bobbin 6. The flange acts as a signal generator 51. A receiver 54, which responds to changes in the magnetic field, is arranged on the front side of the bobbin case 4. The receiver is designed as a Hall sensor 55, whose terminals FIG. 7 are connected to counting device 22 of the control circuit 15. Because the magnets 52 are advantageously designed as permanent magnets, a signal emitter may be omitted.

The second arrangement operates as follows:

When thread is being pulled off from the bobbin 6, the latter is rotated, so that the Hall sensor 55 receives successively magnetic signals of varying intensity. In contrast, a magnetic signal of constant intensity is present during the stoppage of the bobbin as a consequence of thread break or thread end. This signal is evaluated in the above-described manner by the control circuit 15.

Figure 8:
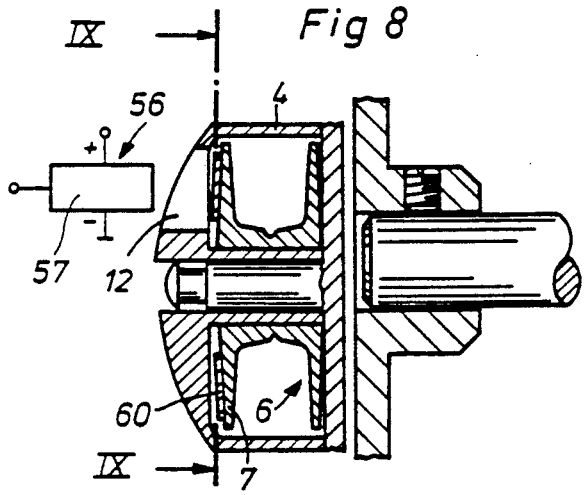
FIG. 8 is a sectional view through another embodiment of the shuttle along line VIII—VIII in FIG. 9.
Figure 9:
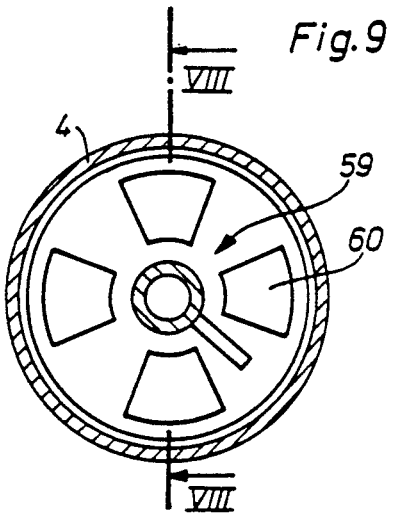
FIG. 9 is a sectional view along line IX—IX in FIG. 8.
Figure 10:
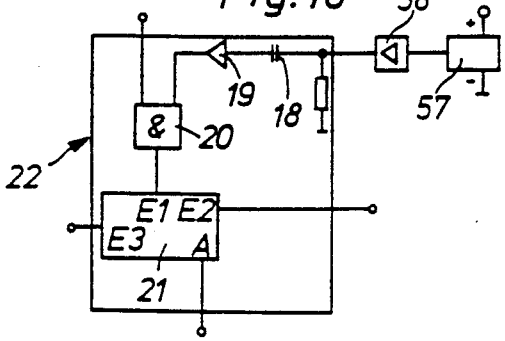
FIG. 10 is a circuit diagram of the counting device associated with the sensor according to FIG. 8.
Figure 11:
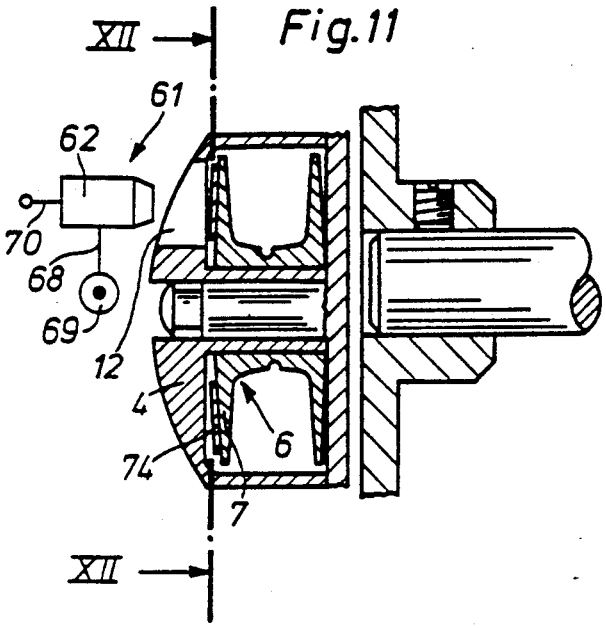
FIG. 11 is a sectional view through another embodiment of the shuttle taken along line XI—XI in FIG. 12.
Figure 12:
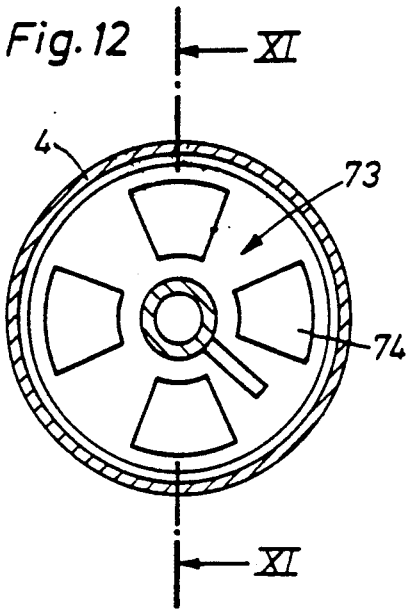
FIG. 12 is sectional view taken along line XII—XII in FIG. 11.

In a third embodiment, a receiver 56 is designed as a proximity switch 57 FIGS. 8 through 10, which is connected to the counting device 22 via an amplifier 58. The flange 7 of the bobbin 6, acts as a signal generator 59 and faces the proximity switch 57. The flange 7 has projections 60 on its outside.

Due to the projections 60, the space between the outer surface of the flange 7 and the proximity switch 57 changes continuously during the rotation of the bobbin 6. As a result of this, the inductance or the capacitance of the proximity switch 57 changes, depending on its design. These changes are evaluated in the above-described manner by the control circuit 15.

Figure 13:
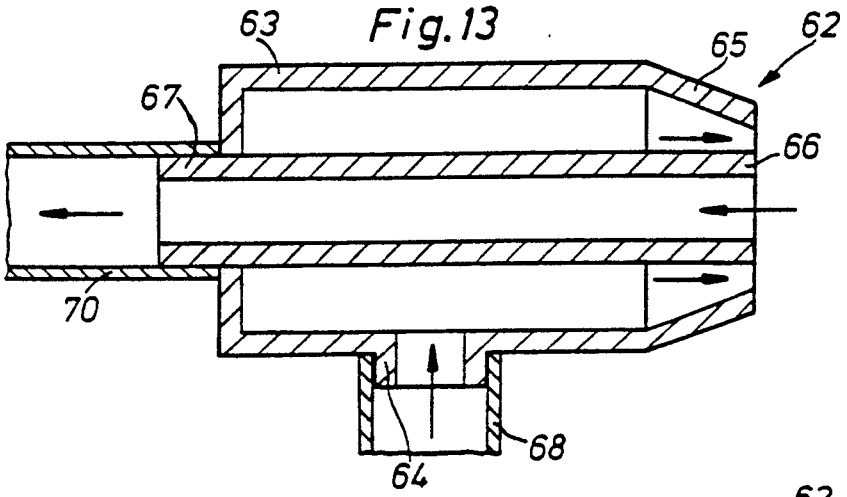
FIG. 13 is an enlarged sectional view of a sensor according to FIG. 11.
Figure 14:
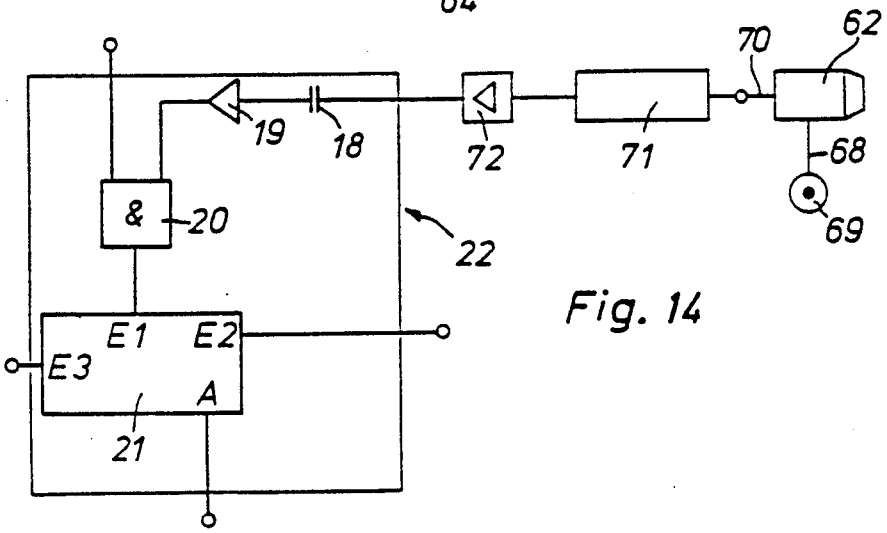
FIG. 14 is a diagram of the counting device associated with the sensor according to FIG. 11.

In another embodiment, the receiver 61 of the thread monitor is a pneumatic ring beam sensor 62 (FIGS. 11 through 14), which is shown in FIG. 13 on a larger scale. The ring beam sensor 62 has a cylindrical housing 63 with an inlet connection 64 and annular discharge nozzle 65. A tube 66, whose free end serves as an inlet opening and whose fixed end serves as a discharge connection 67, is fastened inside the housing 63. The inlet connection 64 is connected via a pressure line 68 to a pressure source 69, and the discharge connection 67 is connected via a pressure line 70 to a pneumatic/electrical transformer 71. The latter is connected to the counting device 22 via an amplifier 72.

The flange 7 of the bobbin 6, acting as a signal generator 73, is provided with projections 74 on its side facing the ring beam sensor 62.

The compressed air admitted through the inlet connection 64 is deflected in the housing 63 and it leaves the ring beam sensor 62 through the discharge nozzle 65. After being deflected on the flange 7, the compressed air enters the tube 66 and leaves the ring beam sensor 62 through the discharge connection 67.

Rotation of the bobbin 6 as a consequence of thread being pulled off brings about pressure changes in the tube 66 because of the changes in the distance between the ring beam sensor 62 and the flange 7. These pressure changes are transmitted to the transformer 71, which transforms them correspondingly for evaluation in the control circuit 15.

The mode of operation of the thread monitor according to the present invention was explained in this embodiment on the basis of bobbin thread monitors. However, the device is also suitable for monitoring the needle thread by arranging the signal generator rotatably in the path of the needle thread and driving the signal generator by the needle thread.

While a specific embodiment of the invention has been shown and described in detail to illustrate the application of the principles of the invention, it will be understood that the invention may be embodied otherwise without departing from such principles.

We claim:

1. A sewing machine and thread monitor arrangement, comprising a bobbin held in a shuttle body, said bobbin having signal reflecting elements for reflecting a sensor signal; sensor means for responding to the bobbin thread running out including means for emitting sensor signals and means for detecting changes in signals reflected by said elements of said bobbin in dependence upon the different reflection characteristics of said elements, said sensor means generating pulse signals; a pulse generator providing one pulse per stick forming cycle; counter means for receiving said pulse signals from said sensor; and, setting means for inputting a presetting input to said counter means defining a maximum count, generating a signal indicating a disturbance in the shuttle thread when said counter means reaches said maximum count at least one additional counting device, for interrupting said signal indicating a disturbance for a number of stitch cycles for using up a slack thread section after a sewing machine function that causes slack thread.

2. Sewing machine in accordance with the claim 1, wherein said at least one additional counting device has activation means which can be activated after an intermediate stop, and after a pre-set number of the main shaft revolutions, which can be predetermined, has been reached, and including means for sending a signal for restoring the switching function of said counter means.

3. Sewing machine in accordance with claim 2, wherein at least one additional counting device is driven after thread cutting, and said additional counting device sends a signal for restoring the switching function of said counter means after a pre-set number of the main shaft revolutions, which can be predetermined, has been reached.

4. Sewing machine in accordance with claim 2, wherein said preset number for the at least one additional counting device can be set for the consumption of slack thread sections of different lengths, which are caused by various machine speeds.

5. Sewing machine in accordance with claim 1, wherein said counter means is actuated as a function of the actual operating state of the sewing machine, based on a number of main shaft revolutions associated with the operating state which occur prior to a sewing operation.

6. A sewing machine with a doublelock stitch shuttle land a thread monitor, comprising: a receiver means for receiving signals of varying intensity from a signal generator means, said signal generating means being connected to a thread bobbin which is set into rotation by the thread being pulled off for supplying signals of different intensities to said receiver means during rotation, and control circuit means connected to said receiver means including a first counting device for counting the revolutions of a main sewing machine shaft during the duration of the reception of signals of one intensity and which is reset to its initial value by the change of these signals to another intensity, and for generating a signal indicating thread disturbance after a preselected maximum number of revolutions has been reached without a change of signal intensity to provide a switching function, at least one additional counting device, for interrupting said switching function for a number of stitch cycles for using up a slack thread section after a sewing machine function that causes slack thread.

7. A sewing machine in accordance with claim 6, wherein said signal generator has a signalgenerating projection, and said signal receiver comprises a proximity switch.

8. A sewing machine according to claim 6, wherein said signal generator includes air reflecting members with alternating air reflecting properties, said signal receiver means comprises a sensor including compressed air transmission means for directing air toward said signal generator and pressure sensing means that can be actuated by pressurized media for sensing changes in intensity of reflected air pressure.

9. A sewing machine according to claim 7, wherein said control circuit includes an additional counting device, which can be activated after an intermediate stop and wherein said additional counting device sends a signal for restoring the switching function of said first counting device intended for the sewing operation after a predetermined maximum number of revolutions of said main shaft.

10. A sewing machine in accordance with claim 7, wherein said control circuit includes an additional counting device, said additional counting device being actuated after thread cutting and having means for sending a signal for restoring the switching function of said first counting device after a predetermined maximum number of revolutions of the main shaft has been reached.

11. A sewing machine according to claim 7, wherein said first counting device of said control circuit is activated depending upon the operating state of said sewing machine, based on a number of revolutions of the main shaft prior to the start of sewing operations.

12. A sewing machine according to claim 7, wherein said control circuit means causes the sewing machine to be stopped after a predetermined number of revolutions have been achieved.

13. A sewing machine according to claim 6, wherein said signal generating means includes signal-generating means and said means for receiving signals includes a Hall sensor.

* * * * *